US005095566A

United States Patent [19]

Russell

[11] Patent Number: 5,095,566

[45] Date of Patent: Mar. 17, 1992

[54] STORAGE LOCKER FOR PRISONS AND METHOD

[76] Inventor: John M. Russell, 503 S. Laurel St., Amite, La. 70422

[21] Appl. No.: 715,414

[22] Filed: Jun. 14, 1991

[51] Int. Cl.[5] ..... A47C 19/22

[52] U.S. Cl. ..... 5/308; 5/2.1; 5/9.1; 5/503.1

[58] Field of Search ..... 5/2.1, 58, 308, 400, 5/503, 9.1; 312/328

[56] References Cited

U.S. PATENT DOCUMENTS

| | | | |
|---|---|---|---|
| 1,385,903 | 7/1921 | Cochran | 5/58 X |
| 1,924,026 | 8/1933 | Clark | 5/308 X |
| 2,565,129 | 8/1951 | Hermani | 312/328 |
| 3,082,435 | 3/1963 | Philips et al. | 5/2.1 |
| 3,745,596 | 7/1973 | Copeland | 5/308 |
| 3,952,342 | 4/1976 | Hart | 5/2.1 |
| 4,109,328 | 8/1978 | Mason | 5/2.1 |
| 4,259,755 | 4/1981 | Hollander | 5/2.1 X |

*Primary Examiner*—Michael F. Trettel
*Attorney, Agent, or Firm*—John Wade Carpenter

[57] ABSTRACT

A storage locker having a bottom and a pair of end walls secured to the bottom. A back wall is secured to the bottom and to the pair of end walls. An angle iron member is secured to the pair of end walls and a locker door is pivotally secured to the angle iron member. The storage locker may be secured to a bed in a prison cell.

20 Claims, 3 Drawing Sheets

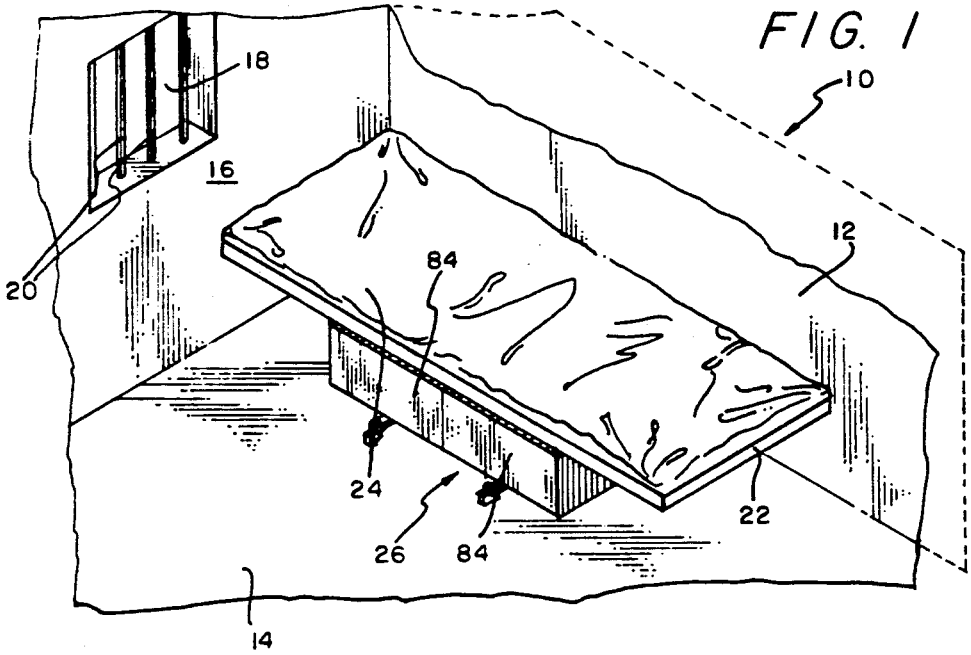
FIG. 1
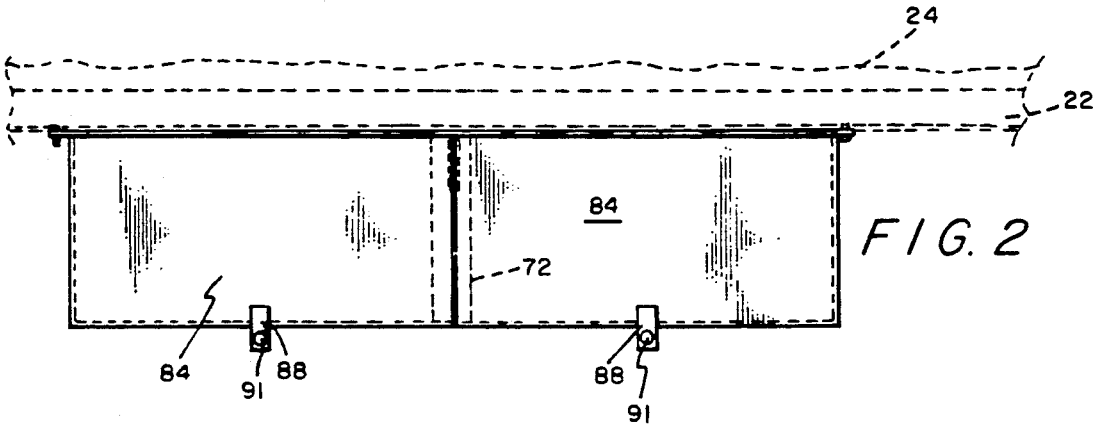
FIG. 2
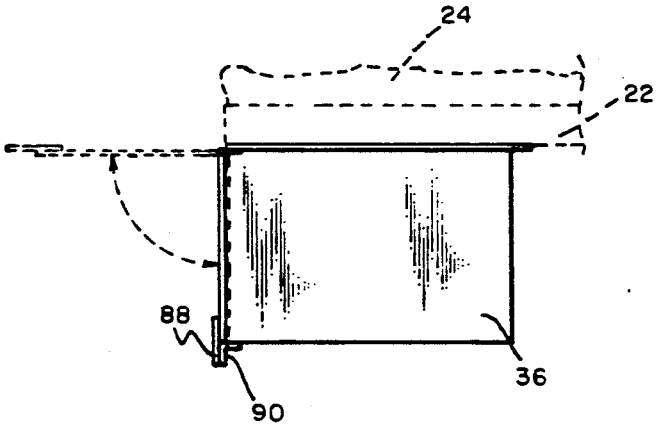
FIG. 3
FIG. 4
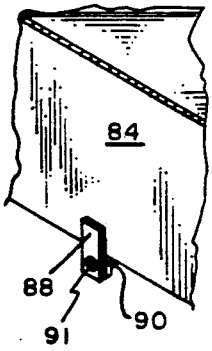

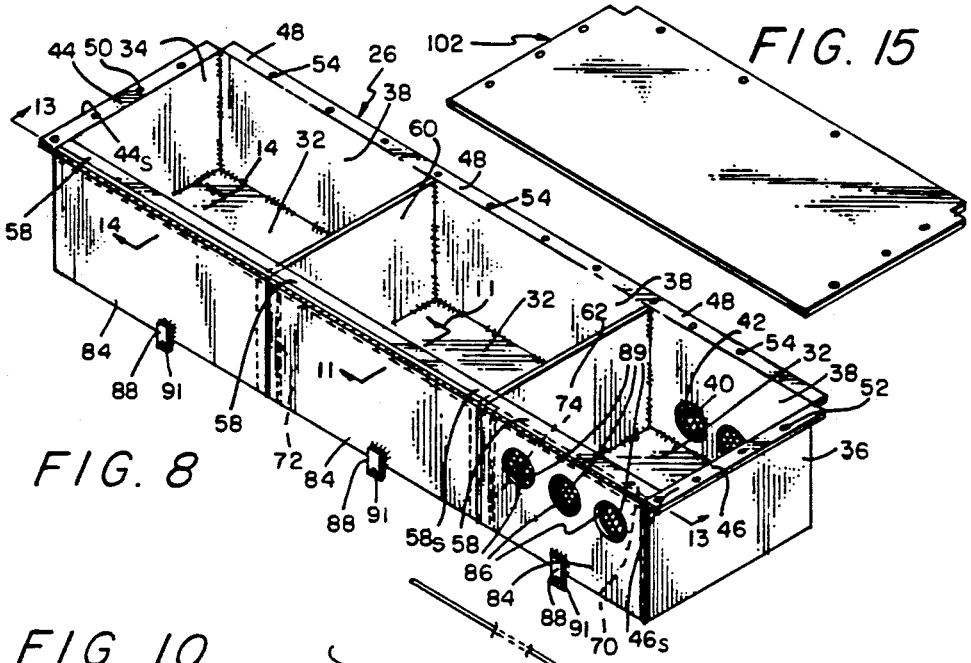
FIG. 15
FIG. 8
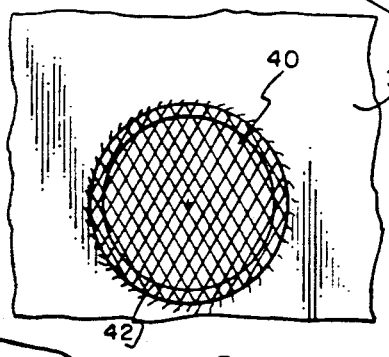
FIG. 10
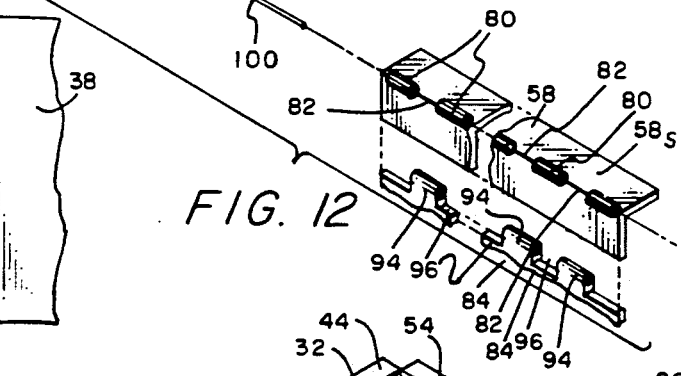
FIG. 12
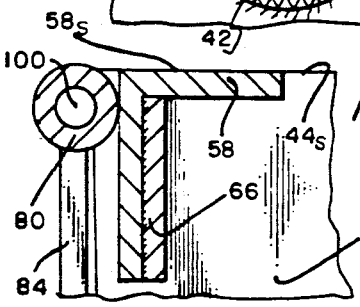
FIG. 14
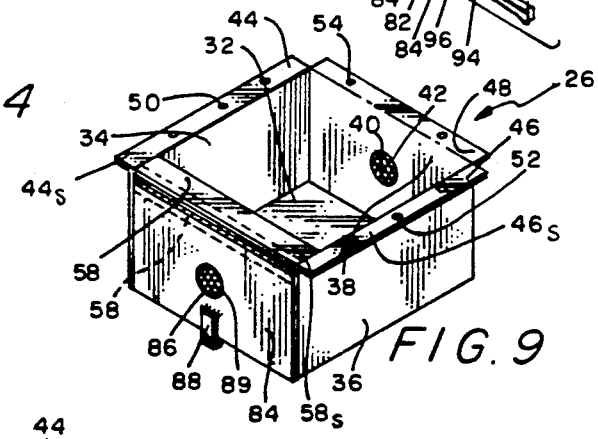
FIG. 9
FIG. 11
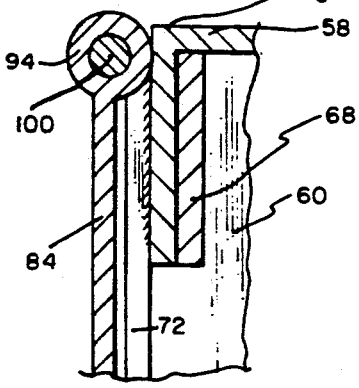
FIG. 13
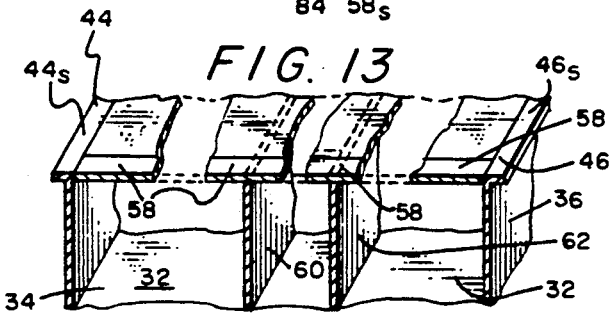

STORAGE LOCKER FOR PRISONS AND METHOD

1. FIELD OF THE INVENTION

This invention is related to a storage locker. More specifically, this invention provides a combined storage locker and bed frame for disposal and use by convicts in a jail or the like, and method for providing convicts with one or more facilities for keeping personal properties underneath the beds where convicts sleep and rest.

DESCRIPTION OF THE PRIOR ART

A patentability investigation was conducted and the following U.S. Patents by Nos. were discovered:

1,924,026—titled: INSTITUTIONAL BED, Clark.

2,239,877—titled: BED, Ciullo.

2,956,290—titled: BOX CONSTRUCTION FOR THE SUPPORT OF A MATTRESS ON A BED, Schneinerman.

3,745,596—titled: COMBINED BED FRAME WITH STORAGE COMPARTMENT, Copeland.

4,869,449—titled: LOCKABLE GUN SAFETY DRAWER, Goodman.

4,928,332—titled: ADJUSTABLE MATTRESS FOUNDATION FOR BEDS, Ogden et al.

None of the foregoing prior art teaches or suggests the particular storage locker(s) and method of the invention.

SUMMARY OF THE INVENTION

The present invention accomplishes its desired objects by providing a combined bed and storage locker for prisons comprising a bed means for supporting an inmate in a prison. The bed means comprises a support platform having at least one side adaptable to mount to a wall of a prison cell. A non-combustible storage locker means is provided and is secured to said support platform for receiving personal belongings, such as soiled laundry and the like, of an inmate. The storage locker means comprises a bottom; and a first end wall secured to the bottom and terminating in a first upper end which defines a first flange member extending outwardly at approximately 90 degrees from the first end wall. A second end wall is secured to the bottom and terminates in a second upper end. A back wall is secured to the bottom and to the first end wall and to the second end wall and terminates in a back upper end defining a back flange member extending outwardly at approximately 90 degrees from the back wall. An angle iron member is secured to the first end wall and to second end wall; and a locker door is pivotally secured to the angle iron member.

The present invention further accomplishes its desired objects by broadly providing a method for providing a convict with a facility for keeping personal properties underneath a bed where the convict sleeps comprising the steps of:

(a) providing a prison cell to confine a convict;

(b) providing a plurality of bars secured to at least one wall of the prison cell;

(c) providing a bed means, secured to a wall of the prison cell, for supporting a convict, said bed means comprising a support platform having at least one side adaptable to mount to said wall of the prison cell; and (d) connecting a storage locker means to said support platform to provide a convict with a facility to keep personal properties, said storage locker means comprising a bottom; a first end wall secured to said bottom and terminating in a first upper end which defines a first flange member extending outwardly at approximately 90 degrees from said first end wall; a second end wall secured to said bottom and terminating in a second upper end; a back wall secured to said bottom and to said first end wall and to said second end wall and terminating in a back upper end defining a back flange member extending outwardly at approximately 90 degrees from said back wall; and an angle iron member secured to said first end wall and to second end wall; and a locker door pivotally secured to said angle iron member.

It is therefore an object of the present invention to provide a combined bed and storage locker.

These, together with the various ancillary objects and features which will become apparent to those skilled in the art as the following description proceeds, are attained by this novel apparatus and method for a storage locker, a preferred embodiment as shown with reference to the accompanying drawings, by way of example only, wherein;

BRIEF DESCRIPTION OF THE INVENTION

FIG. 1 is a perspective view of the storage locker secured to the bottom of a bed in a jail cell;

FIG. 2 is a front elevational view of one embodiment of the storage locker;

FIG. 3 is a side elevational view of the storage locker of FIG. 2;

FIG. 4 is a partial view of a door for the storage locker;

FIG. 8 is a perspective view of another embodiment of the storage locker;

FIG. 9 is a perspective view of still another embodiment of the storage locker;

FIG. 10 is a partial view of the back wall of the storage locker disclosing an opening;

FIG. 11 is a vertical sectional view taken in direction of arrows and along, the plane of line 11—11 in FIG. 8;

FIG. 12 is a partial perspective view of a door separated from the angle iron member and with the shaft removed;

FIG. 13 is a partial vertical view taken in direction of arrows and along the plane of line 13—13 in FIG. 8;

FIG. 14 is a vertical sectional view taken in direction of arrows and along the plane of line 14--14 in FIG. 8;

FIG. 15 is a perspective view of the top member for the storage locker which top member is secured to the flanges of the storage locker before it is connected to a bed or bunk when the bed or bunk would require such a top member.

DETAILED DESCRIPTION OF A PREFERRED EMBODIMENT OF THE INVENTION

Figure 5:
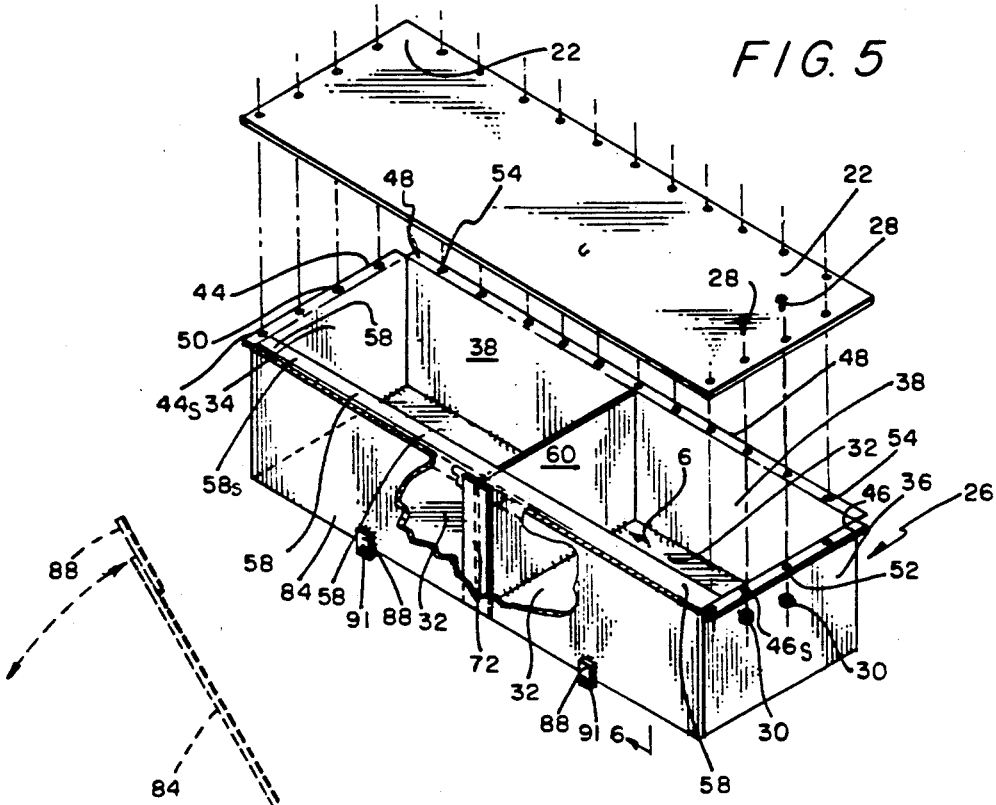
FIG. 5 is a perspective view of another embodiment of the storage locker.
Figure 6:
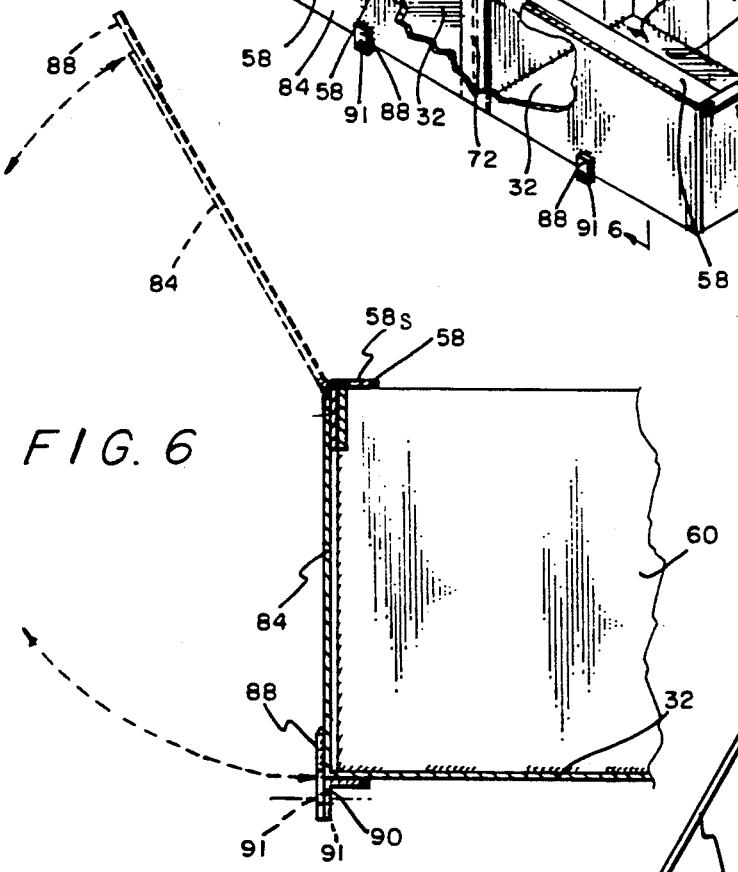
FIG. 6 is a vertical sectional view taken in direction of arrows and along the plane of line 6—6 in FIG. 5.
Figure 7:
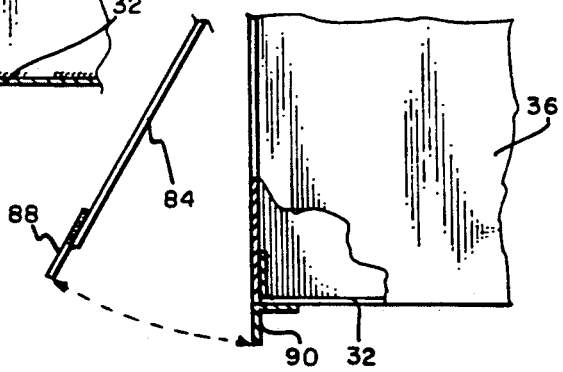
FIG. 7 is a partial side elevational view of the storage locker.

Referring in detail now to the drawings, wherein similar parts of the invention are identified by like reference numerals, there is seen a prison cell, generally illustrated as 10, having a wall 12 secured to a floor 14, and a wall 16 secured to the wall 12 and to the floor 14. Wall 16 has an opening 18 which is covered by a plurality of spaced bars 20 connected to the wall 16 in the opening 18. A support platform 22 is connected to wall 12 and/or wall 16 and may be conveniently covered with a mattress 24 to form a bed where an inmate or convict may sleep and rest.

A storage locker means, generally illustrated as 26, is secured to the bottom of the support platform 22 via a plurality of nuts 28/bolts 30.

The storage locker 26 has a number of preferred embodiments. In each embodiment, the storage locker 26 has a bottom 32, and a pair of end walls 34 and 36 secured to the bottom 32 in an opposed relationship. A back wall 38 connects to the bottom 32 and to the two opposed end walls 34 and 36. The back wall 38 may be formed with at least one opening 40 that is covered with a screen 42 that connects the back wall 38. The opposed end walls 34 and 36 respectively terminate in flange members 44 and 46 that project outwardly about 90 degrees from the end walls 34 and 36. The back wall 38 terminates in a flange member 48 that projects outwardly about 90 degrees from the back wall 38. Flange members 44 and 46 have a plurality of openings 50 and 52 respectively wherethrough bolts 30 may pass to threadably receive and mate with nuts 28 and to secure the support platform 22 to the storage locker 26. Flange member 48 is formed with openings 54 which are also for slidably receiving bolts 30 to threadably receive and mate with nuts 28 for also securing the storage locker 26 to the support platform 22.

The storage locker 26 also has an angle iron member 58, which is preferably L-shaped in configuration. The angle iron member 58 connects to the pair of end walls 34 and 36. In the embodiment for the storage locker 26 in FIG. 5 and FIG. 8, a partition member 60 connects to the bottom 32 and to the back wall 38. In FIG. 8, another partition member 62 is also provided and connects to the back wall 38 and to the bottom 32. Partition members 60 and 62 also connect to angle iron member 58 and are shorter in height than the end walls 34 and 36 by the thickness of the angle iron member 58. Angle iron member 58 has a top planar surface 58*s* that registers or collimates with top planar surfaces 44*s* and 46*s* of the flange members 44 and 46 respectively. A brace member 64 connects to the opposed end walls 34 and 36 and to the angle iron member 58 similar to a brace member 66 which connects to the end wall 34 and to the partition member 60 (see FIG. 14) and to the angle iron member 58. A brace member 68 connects to the partition members 60 and 62 and to the angle iron member 58 (see FIG. 11). A brace member 70 connects to partition member 62 and to the end wall 36 and to the angle iron member 58 similar to the manner in which brace member 66 connects to the end wall 34 and to the partition member 60 (see FIG. 14) and to the angle iron member 58. As best shown in FIG. 5, a front flange member 72 connects to an end of the partition member 60 and functions as a door stop. Similarly, a front flange member 74 connects to an end of the partition member 62 (see FIG. 8) and also functions as a door stop. Partition members 60 and 62 connect to front flange member 72 and 74 respectively such as to traverse a center line of same.

The angle iron member 58 is formed with a plurality of hollow cylindrical members 80 (see FIG. 12) which are secured to the angle iron member 58 in a spaced relationship such as to provide a plurality of hollow cylindrical members 80. The storage locker 26 includes at least one door 84 pivotally secured to the angle iron member 58. In the embodiment of the invention in FIG. 9, one door 84 is pivotally connected to the angle iron member 58. In the embodiment of the invention in FIGS. 5 and 8, there are two doors 84—84 and three doors 84—84—84, respectively, pivotally connected to the angle room member 58. Door 84 may be formed with at least one opening 86 which may be covered with screen 88 that connects to the door 84. Door 84 may also be formed with a tag or tab member 88 secured to the door 84 in a depending relationship to mate (when the door 84 is closed) with an L-shaped bracket 90 connected to the bottom 32 of the storage locker 26. Tab member 88 and bracket 90 are each formed with an opening 91 which are aligned with each so that a lock 92 may pass through both openings 91—91 to lock the door 84.

The top of each of the doors 84 is formed with a plurality of spaced cylindrical members 94 that are secured to the door 84 in a spaced relationship to provide a plurality of spaces 96 between the spaced cylindrical members 94. The spaced cylindrical members 94 are slidably disposed in the plurality of spaces 82 and the spaced cylindrical members 80 are slidably disposed in the spaces 96 such that the cylindrical members 94 are aligned with the cylindrical members 80. After alignment, a shaft 100 slidably passes in and through the hollow cylindrical members 80 and 94 to pivotally secure the door 84 to angle iron member 58 such that the door can pivot up and down on the angle iron member 58.

The storage locker 26 of the present invention may be constructed from any non-combustible material preferably 12 and/or 18 gauge steel. All connections, unless otherwise indicated, are welded for strength. Optionally, a top member, generally illustrated as 102 in FIG. 14, may be disposed over and secured to the storage locker 26 before the storage locker 26 is secured to a bed support member, such as by way of example only, support member 22.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A combined bed and storage locker for prisons comprising a bed means for supporting an inmate in a prison, said bed means comprising a support platform having at least one side adaptable to mount to a wall of a prison cell; a non-combustible storage locker means, secured to said support platform, for receiving soiled laundry and the like of an inmate, said storage locker means comprising a bottom; a first end wall secured to said bottom and terminating in a first upper end which defines a first flange member extending outwardly at approximately 90 degrees from said first end wall; a second end wall secured to said bottom and terminating in a second upper end; a back wall secured to said bottom and to said first end wall and to said second end wall and terminating in a back upper end defining a back flange member extending outwardly at approximately 90 degrees from said back wall; and an angle iron member secured to said first end wall and to second end wall; and a locker door pivotally secured to said angle iron member.

2. The combined bed and storage locker of claim 1 wherein said second upper end defines a second flange member extending outwardly at approximately 90 degrees from said second end wall.

3. The combined bed and storage locker of claim additionally comprising a first partition member secured to said bottom and to said back wall.

4. The combined bed and storage locker of claim 3 additionally comprising a second partition member secured to said bottom and to said back wall.

5. The combined bed and storage locker of claim 4 additionally comprising a first brace member secured to said angle iron and to said first end wall and to said first partition member.

6. The combined bed and storage locker of claim 5 additionally comprising a second brace member secured to said angle iron and to said first partition member and to said second partition member, and a second locker door pivotally secured to said angle iron between said first and second partition members.

7. The combined bed and storage locker of claim 6 additionally comprising a third brace member secured to said angle iron member and to said second partition member and to said second end wall; and a third locker door pivotally secured to said angle iron between said second partition member and said second end wall.

8. The combined bed and storage locker of claim 7 additionally comprising a plurality of spaced angle iron hollow cylindrical members secured to said angle iron in a spaced relationship such as to provide a plurality of angle iron spaces between said plurality of spaced angle iron hollow cylindrical members.

9. The combined bed and storage locker of claim 8 additionally comprising a plurality of spaced door hollow cylindrical members secured to said locker door in a spaced relationship such as to provide a plurality of door spaces between said plurality of spaced door hollow cylindrical members, said spaced door hollow cylindrical members being slidably disposed in said plurality of angle iron spaces and said spaced angle iron hollow cylindrical members being slidably disposed in said plurality of door spaces; and a shaft slidably disposed in said spaced angle iron hollow cylindrical members and in said spaced door hollow cylindrical members such that said locker door can pivot up and down on said angle iron member.

10. The combined bed and storage locker of claim 9 wherein said back wall has a structure defining at least one opening; and at least one screen member connected to said back wall and disposed over said opening.

11. The combined bed and storage locker of claim 1 additionally comprising a brace member secured to said angel iron member and to said first and second end wall.

12. The combined bed and storage locker of claim 11 additionally comprising a plurality of spaced angle iron hollow cylindrical members secured to said angle iron in a spaced relationship such as to provide a plurality of angle iron spaces between said plurality of spaced angle iron hollow cylindrical members.

13. The combined bed and storage locker of claim 12 additionally comprising a plurality of spaced door hollow cylindrical members secured to said locker door in a spaced relationship such as to provide a plurality of door spaces between said plurality of spaced door hollow cylindrical members, said spaced door hollow cylindrical members being slidably disposed in said plurality of angle iron spaces and said spaced angle iron hollow cylindrical members being slidably disposed in said plurality of door spaces; and a shaft slidably disposed in said spaced angle iron hollow cylindrical members and in said spaced door hollow cylindrical members such that said locker door can pivot up and down on said angle iron member.

14. The combined bed and storage locker of claim 13 wherein said back wall has a structure defining at least one opening; and at least one screen member connected to said back wall and disposed over said opening.

15. The combined bed and storage locker of claim 14 wherein said locker door has a structure defining at least one aperture; and at least one screen member connected to said locker door and disposed over said aperture.

16. The combined bed and storage locker of claim 15 wherein said first flange member has a structure defining a plurality of first flange openings, and said back flange member has a structure defining a plurality of back flange openings; and said first flange member and said back flange member are secured against a bottom of said support platform.

17. The combined bed and storage locker of claim 16 additionally comprising a prison cell having a first prison wall whereto said support platform is secured, and a second prison wall secured to said first prison wall and having a structure defining at least one prison opening, and a plurality of prison bars secured to said second prison wall in said prison opening.

18. The combined bed and storage locker of claim 14 wherein said second locker door has a structure defining at least one aperture; and at least one screen member connected to said locker door and disposed over said aperture.

19. The combined bed and storage locker of claim 18 wherein said first flange member has a structure defining a plurality of first flange openings, and said second flange member has a structure defining a plurality of second flange openings, and said back flange member has a structure defining a plurality of back flange openings; and said first flange member and said second flange member and said back flange member are secured against the bottom of said support platform.

20. A method for providing a convict with a facility for keeping personal properties underneath a bed where the convict sleeps comprising the steps of:

(a) providing a prison cell to confine a convict;

(b) providing a plurality of bars secured to at least one wall of the prison cell;

(c) providing a bed means, secured to wall of the prison cell, for supporting a convict, said bed means comprising a support platform having at least on side adaptable to mount to a wall of the prison cell;

(d) connecting a storage locker means to said support platform to provide a convict with a facility to keep personal properties, said storage locker means comprising a bottom; a first end wall secured to said bottom and terminating in a first upper end which defines a first flange member extending outwardly at approximately 90 degrees from said first end wall; a second end wall secured to said bottom and terminating in a second upper end; a back wall secured to said bottom and to said first end wall and to said second end wall and terminating in a back upper end defining a back flange member extending outwardly at approximately 90 degrees from said back wall; and an angle iron member secured to said first end wall and to second end wall; and a locker door pivotally secured to said angle iron member.

* * * * *